United States Patent [19]

Logan

[11] Patent Number: 4,584,913

[45] Date of Patent: Apr. 29, 1986

[54] COMPACT RATCHET WRENCH WITH QUICK-RELEASE LEVER

[75] Inventor: George T. Logan, Glenmoore, Pa.

[73] Assignee: Thomas Logan, Doylestown, Pa.

[21] Appl. No.: 632,030

[22] Filed: Jul. 18, 1984

[51] Int. Cl.[4] ..... B25B 13/28

[52] U.S. Cl. ..... 81/91.2; 81/111

[58] Field of Search ..... 81/99, 111, 90.2, 91.2

[56] References Cited

U.S. PATENT DOCUMENTS 1,183,371 5/1916 Ginsburg ..... 81/111

2,047,548 7/1936 Colognori et al. ..... 81/111

FOREIGN PATENT DOCUMENTS 1060807 7/1959 Fed. Rep. of Germany ..... 81/90.9

1403411 10/1968 Fed. Rep. of Germany ..... 81/111

*Primary Examiner*—James L. Jones, Jr.

*Attorney, Agent, or Firm*—Gregory J. Gore

[57] ABSTRACT

This invention relates to an improved "lever lock" type wrench which has ratchet characteristics and a novel construction which makes it convenient to use. The construction includes an angled and compact head portion, a quick-release lever, and fully enclosed internal working elements which protects them from grease and dirt. Furthermore, a particular geometry is disclosed which permits the minimum amount of handle rotation for the wrench jaws to achieve the next successive grip in the ratcheting mode.

4 Claims, 8 Drawing Figures

FIG. 1
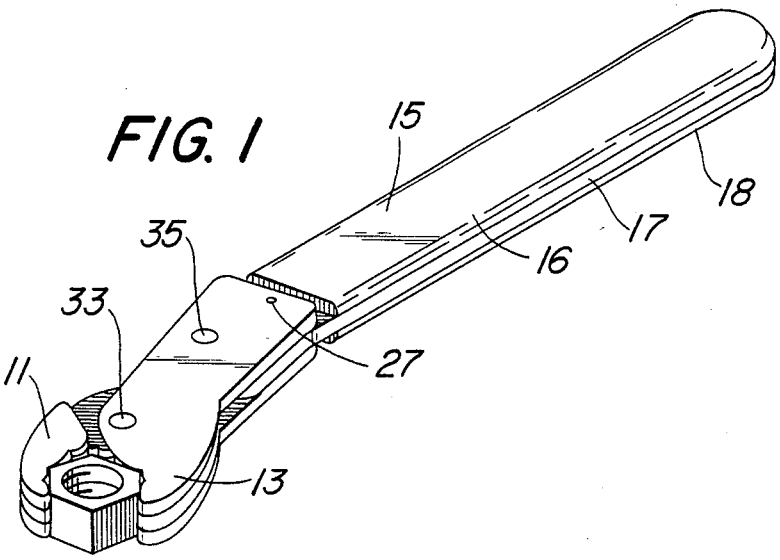
FIG. 2
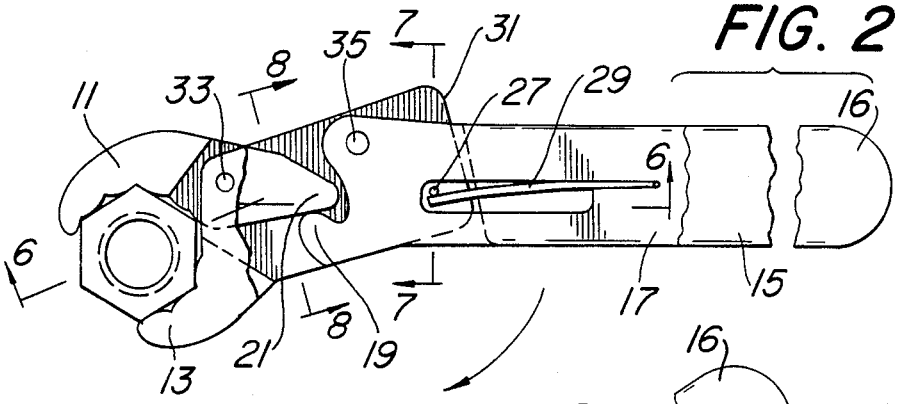
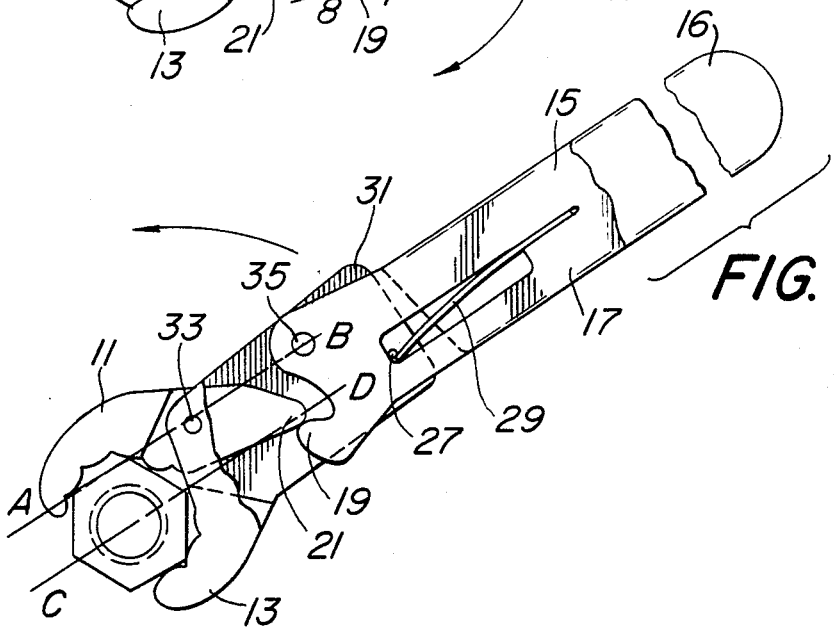
FIG. 3

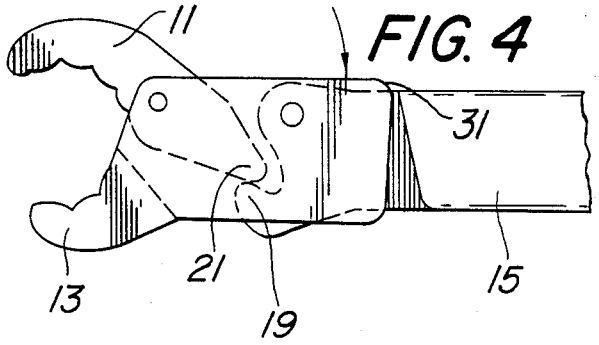
FIG. 4
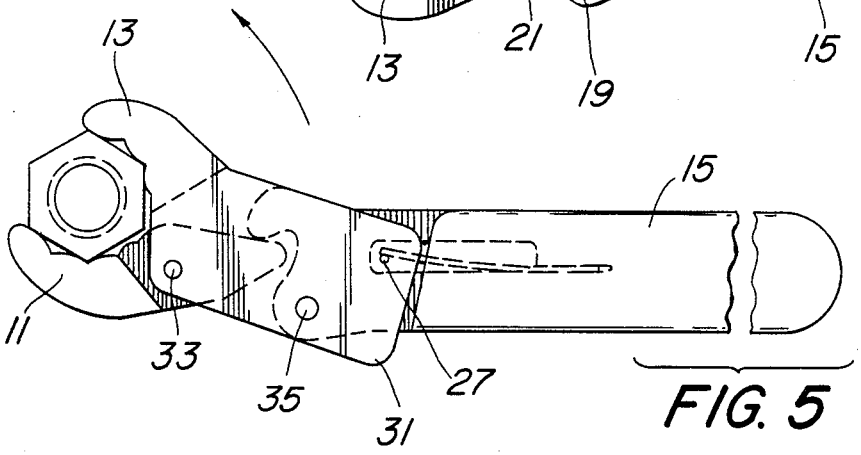
FIG. 5
FIG. 6
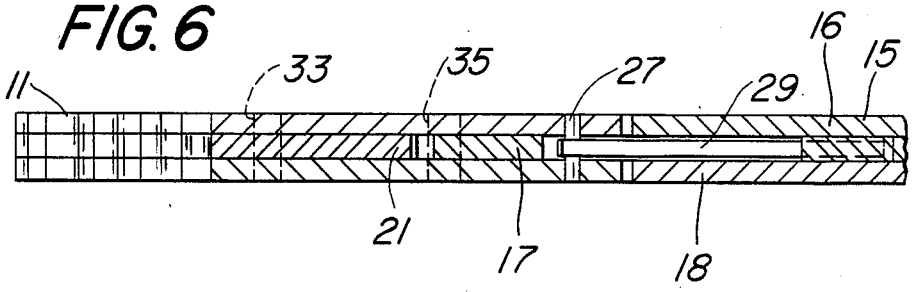
FIG. 7
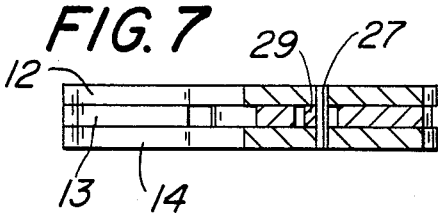
FIG. 8
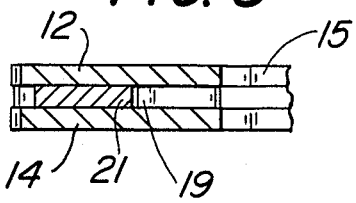

COMPACT RATCHET WRENCH WITH QUICK-RELEASE LEVER

FIELD OF THE INVENTION

This invention relates to ratchet wrenches of the type referred to as having "lever lock" pivotal jaws working on a double pivot system whereby handle rotation forces the pivotal jaws together. More specifically, my invention relates to a specific group of improvements upon the ratchet wrenches shown in my earlier U.S. Pat. No. 2,537,838 dated Jan. 9, 1951 and U.S. Pat. No. 2,618,996 dated Nov. 26, 1952. Both of my prior patents describe in detail the general engineering principles of this type of non-slip ratcheting wrench which are hereby incorporated herein by reference.

PRIOR ART

There have been many attempts to achieve the objects of my invention by way of a lever-lock design as described in the following U.S. patents: Ginsburg, U.S. Pat. No. 1,183,371; Milentz, U.S. Pat. No. 2,937,550; Turner, U.S. Pat. No. 1,718,719, and Briles U.S. Pat. No. 2,015,782.

However, all of these attempts fail to achieve the results of my invention or to overcome the longstanding problems with this design which have prevented its widespread commercial use in such applications as automotive mechanics. Typically, the problem with previous wrenches of this type is that they are generally large, heavy and bulky and cannot be used successfully in tight working spaces. Furthermore, the necessary hand rotation between successive gripping points in achieving the ratcheting effect is usually about 60°, and this also hampers the use of this design in tight working spaces. Also, previous designs have failed to incorporate a slender and compact design of the jaws which is a further limitation on its use in a situation where a casting or phlange housing is close to a nut or bolt. Another problem which has not been solved by previous designs is that the internal cooperating elements of the lever lock wrenches need to be protected from grease, oil, dirt and the like which are typically present in the environment of most work situations.

Finally, the previous designs were clumsy in operation because it was often difficult to apply the wrench to the nut or bolt or to remove it because typically, the jaws are spring biased closed and must first be opened to either accept or be removed from the nut or bolt workpiece.

SUMMARY OF THE INVENTION

The particular construction of the instant invention is a marked improvement over both by previous ratchet wrenches and which achieves the further objects as further set forth herein. These are:

It is the object of the instant invention to provide a ratcheting open-end wrench with a very compact head which fits easily into tight working spaces.

It is another object of the instant invention to provide a ratcheting open-end wrench with a quick release requiring a minimum amount of handle motion to ratchet back to the next possible grip point.

It is a further object of the instant invention to provide a ratchet wrench with a unique construction whereby dirt and grease cannot find their way into the internal moving parts of the wrench.

It is an additional object of the instant invention to provide a ratcheting open-end wrench with a finger operated jaw release lever to increase the ease of applying or removing the wrench from the nut, bolt or other workpiece.

The above objects are achieved by the unique design of my invention. The present ratchet wrench disclosed herein is a very slender and compact design with an angled head, a quick-release finger operated lever, and fully enclosed internal working parts.

It has also been discovered through my extensive research that the particular geometry of the pin locations and lever shapes are the best suited requiring a minimum amount of handle rotation yet providing sufficient gripping force between the jaws. Of particular importance is the location of both pivot pins which ideally should lie along a line which is tangent to the inner radius of the moveable jaw. Using this geometry, together with the number of gripping notches in the jaws, the instant ratchet wrench requires only 30° of handle rotation to achieve the next successive gripping point in the ratching mode as compared to 60° of handle rotation required by previous designs.

DESCRIPTION OF THE DRAWINGS

FIG. 1 shows an isometric view of the invention shown gripping a typical hexagonal nut.

FIG. 2 shows a side cutaway view with the inner working elements shown as the wrench is used in the tightening mode.

FIG. 3 is another cutaway view of the side view of the instant invention showing its operation in the ratcheting or counter-clockwise mode.

FIG. 4 shows the relationship between cooperating elements while the release lever is depressed.

FIG. 5 shows the same view as FIG. 3 except with the same wrench turned over to illustrative how the same ratcheting effect can be achieved with counter-rotation.

FIG. 6 is a sectional view of FIG. 2.

FIG. 7 shows a sectional view of FIG. 2.

FIG. 8 shows a sectional view as taken from FIG. 2.

DESCRIPTION OF THE PREFERRED EMBODIMENT

Referring now to FIGS. 2 and 3, the instant invention is shown in the gripping mode with a typical hexagonal nut being grasped between jaws 11 and 13. Both jaws are generally curved and have notched inner radii for gripping on a twelve point format. Moveable jaw 11 is rotatably mounted to stationary jaw 13 by pin member 33. Stationary jaw 13 having side plates 12 and 14 as shown in FIGS. 7 and 8. The side plates form a yoke which surrounds the narrowed portion of moveable jaw 11 which includes an extension, nose lever 21. Similarly, handle 15 has a narrowed portion at its end which lies between the side plates of stationary jaw 13 and is pinned by pin member 35 therebetween. Handle 15 contains a projection, toe lever 19, which frictionally engages nose lever 21 to provide the gripping force between the jaws. Leaf spring member 29 is mounted within handle 15 and acts upon pin stop 27 to return handle 15 to a neutral position. Also, pin stop 27 is fixed in lower jaw 13 and moves within the cutaway shown in the handle 15 thereby restricting the relative movement between the handle and the stationary lower jaw.

As shown in FIG. 3, the location of pin members 33 and 35 are such that they lie generally along a line A-B which is tangent to the inner radius of moveable jaw 11. Furthermore, the contact point between the nose lever and toe lever is generally along a line parallel to a second line C-D which connects the axis of the workpiece and the point at which the nose lever and toe lever engage. This particular geometry has been shown to provide a quick-release motion during the ratcheting counter-rotation mode which decreases the required amount of handle motion to achieve the next successive grip on the workpiece.

Stationary jaw 13 is provided with a release lever projection 31, which is conveniently located along the length of handle 3 so that it may be finger actuated by the operator in the usual hand-grip positon. By depressing this lever as shown in FIG. 4, the stationary jaw 13 can be manually rotated against the bias of leaf spring 29 which is opposite to the direction of the normal gripping mode and, therefore, the grip is released. This is made possible because the spring leaf member acts between the handle and the stationary jaw rather than between the two jaws as in most of the previous designs. This means that the release lever can be located away from the jaws along the length of the handle which permits a more compact wrench head and also locates the lever in the position where it can be most easily used. FIG. 4 shows by indication of the arrow the lever projecteion 31 being depressed which then rotates the stationary jaw as described.

As can be seen by FIGS. 6, 7 and 8, the interworking elements of the handle and jaws are encased within the side plates 12 and 14 of stationary jaw 13 and the handle side pieces 16 and 18. The slimness of this design affords a very compact and easily operated wrench as well as protecting the crucial sliding contact points of nose and toe lever elements from dirt and grease which could otherwise jam these elements and limit its operation. Furthermore, spring member 29 is also fully enclosed within the handle as is pin 27 and similarly, these elements are protected from the adverse effect of foreign matter.

Of particular importance is the three-piece construction of handle 15. Side pieces 16 and 18 are joined to a center piece 17 which is formed to provide a cutaway which receives spring member 29. In this way, a pocket is formed to encase the spring mechanism.

To make the wrench easier to use, the head portion has been angled approximately 30° from the handle as can be seen from the various drawings.

OPERATION

As will be readily understood from the drawings and the foregoing description, the instant wrench will either tighten or ratchet in one direction only. If the workpiece needs to be loosened or turned in the opposite direction, the wrench is simply turned over and the directions of this operation are thereby reversed permitting the ratcheting effect to be utilized in either tightening or loosening operations. One of the most important advantages of the instant invention is the very limited degree of handle rotation required during the ratcheting mode. In this case, that is limited to 30° of rotation or next possible grip on a 12-point format. This is permitted by the very special geometry as mentioned earlier together with the fact that the bias spring is located between the handle and the stationary jaw. This means that the handle rotates with respect to the stationary jaw only as much as needed to open the jaw slightly so that the nut slips within the notched portions to the next successive grip point. The interconnecting elements of nose lever and toe lever remain in contact during the ratcheting operation, always ready for the handle rotation to be reversed and the gripping mode to begin without having any play between the inter-connecting elements.

Another important feature of the instant invention is the quick-release lever which can easily be finger actuated to facilitate grasping the workpiece initially or removing it. Depressing the lever rotates the stationary jaw against the bias leaf spring and creates a gap between the normal contact points of the nose lever and toe lever as illustrated in FIG. 4. In this situation, moveable jaw 11 swings freely about pivot point 33, restricted only by the motion of the nose lever within the contour of the dimension of the end of the handle. The tips of the jaws are curved and, thereby, the jaws are wedged open when forced against a workpiece. Since moveable jaw 11 swings freely, while the release lever is depressed, the jaws then open without any effort to accommodate the nut or bolt. Similarly, the wrench may be removed from a workpiece by depressing the quick release lever.

While the preferred embodiment of the present invention has been shown and described herein, it is obvious that many structural details may be changed without departing from the meaning and scope of the invention, which is to be solely derived from the appended claims and their legal equivalent.

What I claim is:

1. A ratchet wrench, comprising:

(a) a stationary jaw having notches for gripping a workpiece such as a nut or bolt and two extended sideplates forming a yoke;

(b) a handle pivotally affixed to said stationary jaw, said handle having a narrow extended portion lying between said stationary jaw sideplates;

(c) a first pin member connecting said stationary jaw and said handle;

(d) a moveable jaw opposite said stationary jaw and having notches compatible with the notches on the stationary jaw, said moveable jaw having a narrow extended portion lying between said stationary jaw sideplates and being pivotably affixed thereto;

(e) a second pin member connecting said moveable jaw and said stationary jaw;

(f) a nose lever extending from said moveable jaw between the stationary jaw sideplates;

(g) a toe lever extending from the handle between the stationary jaw sideplates being located to frictionally engage said nose lever such that the turning of the handle will act to close the stationary jaw and moveable jaw about a workpiece such as a nut or bolt;

(h) a resilient leaf spring member affixed between the handle and the stationary jaw;

(i) said handle comprising three parts joined together; two side pieces and a center piece, said center piece formed to receive said leaf spring member, whereby said leaf spring member is partly enclosed within said handle;

(j) a release lever formed from the extension of the stationary jaw sideplates;

(k) said first and second pin members being located along a line tangent to the inner radius of the moveable jaw; and (l) said nose lever and said toe lever engaging at a point approximately along a first line parallel to a second line which connects the first and second pin members, said first line passing through the axis of the workpiece.

2. The ratchet wrench described in claim 1 wherein the head portion is angled approximately 30° with respect to the handle.

3. The ratchet wrench described in claim 2 further including a pin stop member affixed to said stationary jaw and cooperating with said handle to limit the relative movement between said stationary jaw and said handle.

4. The ratchet wrench described in claim 3 wherein said pin stop member also acts to engage said leaf spring member.

* * * * *